United States Patent [19]

Ninomiya et al.

[11] Patent Number: 4,548,179

[45] Date of Patent: Oct. 22, 1985

[54] AIR-FUEL RATIO CONTROL SYSTEM

[75] Inventors: Masakazu Ninomiya, Kariya; Masaya Fujimoto, Ohbu, both of Japan

[73] Assignee: Nippondenso Co., Ltd., Kariya, Japan

[21] Appl. No.: 623,219

[22] Filed: Jun. 21, 1984

[30] Foreign Application Priority Data

Jun. 23, 1983 [JP] Japan ..... 58-113982

[51] Int. Cl.[4] ..... F02M 7/18

[52] U.S. Cl. ..... 123/440; 123/489

[58] Field of Search ..... 123/440, 489

[56] References Cited

U.S. PATENT DOCUMENTS 4,156,413 5/1979 Taplin ..... 123/489 X
4,169,440 10/1979 Taplin et al. ..... 123/489
4,354,468 10/1982 Sone et al. ..... 123/440
4,363,306 12/1982 Sone et al. ..... 123/440

FOREIGN PATENT DOCUMENTS 57-48648 3/1982 Japan .
58-20950 2/1983 Japan .

*Primary Examiner*—Tony M. Argenbright
*Attorney, Agent, or Firm*—Cushman, Darby & Cushman

[57] ABSTRACT

An air-fuel ratio control system for an internal combustion engine in which the air-fuel ratio of the engine is controlled by feedback using an air-fuel ratio sensor of a critical current type. When the air-fuel ratio is not controlled by such feedback, the voltage applied to the air-fuel ratio sensor is reduced or cut off to reduce physical deterioration thereof.

9 Claims, 10 Drawing Figures

AIR-FUEL RATIO CONTROL SYSTEM

BACKGROUND OF THE INVENTION

1. Field of the Invention

The present invention relates to an air-fuel ratio control system in which the concentration of oxygen contained in the engine exhaust gas is detected and the amount of air or fuel supplied to the engine is regulated to thereby regulate the air-fuel ratio of the mixture gas to a desired target value.

2. Description of the Prior Art

An air-fuel ratio sensor of a critical current detection type has been developed to permit detection of a given air-fuel ratio higher (lean side) than a stoichiometric air-fuel ratio. Air-fuel ratio sensors of this type are already known such as disclosed in Japanese Patent Laid-Open No. 48648/82 or No. 20950/83.

Such a conventional air-fuel ratio control system is schematically shown in FIGS. 1, 2*a* and 2*b*. In FIG. 1, reference numeral 1 designates an air-fuel ratio sensor. Numeral 1*a* designates a solid electrolytic element in cup shape with an end open and the other end closed. This element 1*a* includes a cup-shaped sintered metal oxide of oxygen ion conductive property, an electrode 2 on the interior of the sintered member exposed to a reference oxygen such as the atmosphere, an electrode 3 and a diffusion resistance layer 4 on the exterior thereof through which the element is exposed to a test gas to be detected.

Assume that the sensor 1 is constructed of a single electrode in such a manner as to generate a critical current corresponding to an oxygen concentration of a region leaner than the stoichiometric air-fuel ratio. The electrode 3 on test gas side has an area of 10 to 100 $mm^2$, and a thickness of 0.5 to 2.0$\mu$, while the atmosphere-side electrode 2 has an area of 10 $mm^2$ or more and a thickness of 0.5 to 2.0$\mu$. Both electrodes are made of a precious metal of high catalytic activity such as platinum formed sufficiently porous by chemical plating or galvanization, sputtering or paste screen printing. The diffusion resistance layer 4 is formed by plasma spray coating or like of $Al_2O_3$, $Al_2O_3.MgO$ or $ZrO_2$ to the thickness of 100 to 700$\mu$, porosity of 7 to 15% and mean pore size of 600 to 1200 Å. The critical current value corresponding to the oxygen concentration depends on the area of the electrode 3, and the thickness, porosity and mean pore size of the diffusion resistance layer 4, so that these factors must be controlled and specified in high accuracy. Numeral 5 designates a heater, numerals 2*a*, 3*a* and 5*a* lead wires.

The functions of the sensor will be explained. The element 1*a* is secured to the exhaust pipe of the internal combustion engine. As well known, the exhaust gas is composed of such components as $O_2$, CO and HC, the concentrations of which change with the air-fuel ratio on combustion side. The air-fuel ratio sensor includes the element with the porous electrode on each side thereof. An electric current is supplied between the electrodes of the element to thereby cause a diffusion of oxygen ions of the exhaust gas from one electrode to the other electrode through the element. A limit or critical current is known to exist in a region where the current flowing between the electrodes remains unchanged with changes in the applied voltage. The concentration of oxygen in the exhaust gas is thus capable of being determined by measuring such a critical current value upon application of a predetermined voltage of 0.6 to 0.8 V. It is thus possible to attain the optimum air-fuel ratio in the lean region on the basis of the oxygen concentration determined as above.

When the sensor output air-fuel ratio is about 13, however, the oxygen concentration in the exhaust gas is almost zero without any oxygen ions being generated. Under this condition, an engine endurance test shows that $ZrO_2$ which is the main component constituting the air-fuel ratio sensor is decomposed to accelerate degeneration of the sensor.

SUMMARY OF THE INVENTION

Accordingly, it is the object of the present invention to provide an air-fuel ratio control system in which, in order to minimize the degeneration of the air-fuel ratio sensor, the voltage applied to the air-fuel ratio sensor is reduced or cut off when the engine is not operated under the feedback control using the output of the air-fuel ratio sensor.

DESCRIPTION OF THE PREFERRED EMBODIMENTS

Figure 1:
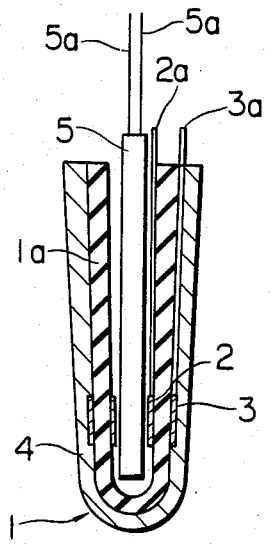
FIGS. 1, 2*a*, and 2*b* show a sectional view and characteristic diagrams respectively of an air-fuel ratio sensor of a critical current type.
Figure 2A:
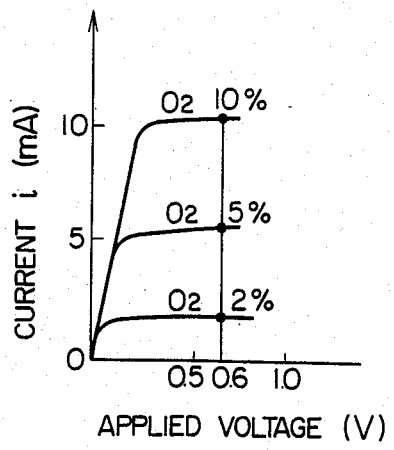
Figure 2B:
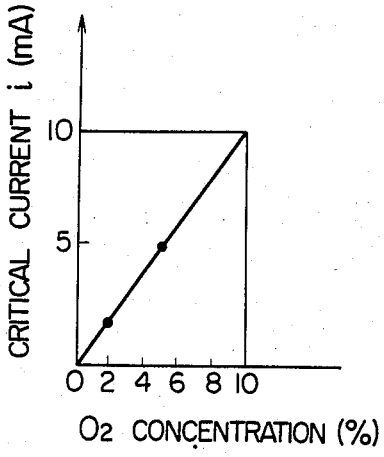
Figure 3:
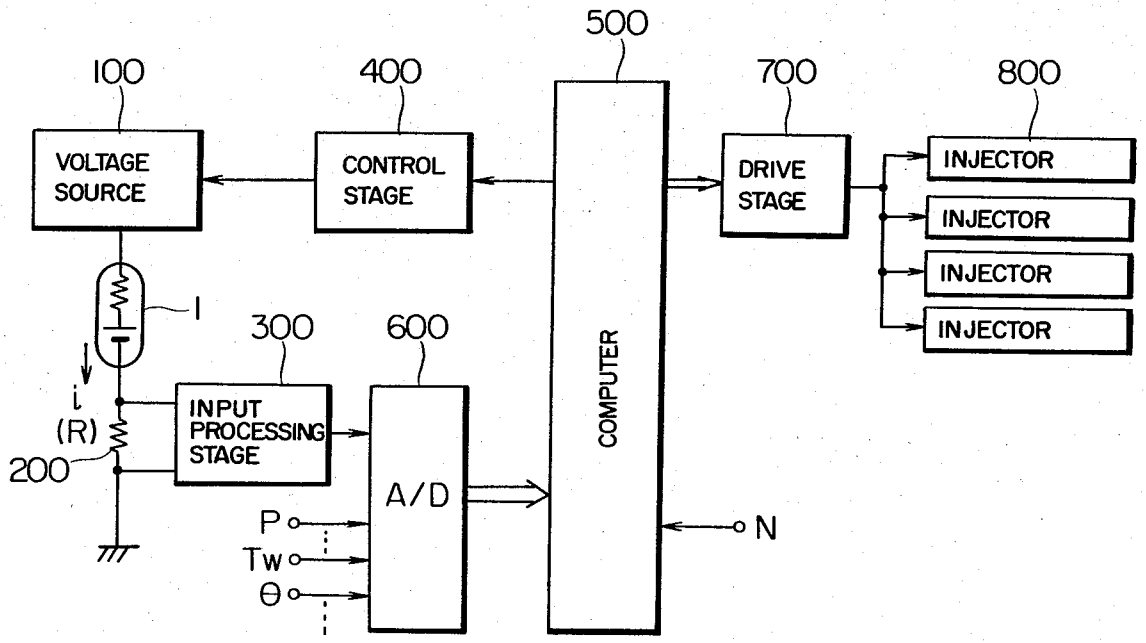
FIG. 3 is a block diagram showing an embodiment of the present invention.

An embodiment of the present invention will be explained with reference to the drawings. A general configuration of a system according to the present invention is shown in FIG. 3. An air-fuel sensor 1 is mounted on an engine exhaust pipe not shown to produce a critical current i proportional to the oxygen concentration in the exhaust gas. Numeral 100 designates a voltage source for applying a predetermined voltage between 0.6 and 0.8 V to the air-fuel ratio sensor 1 to generate a desired critical current as shown in FIG. 2*a*. As a result, the critical current i proportional to the oxygen concentration is obtained as shown in FIG. 2*b*. Numeral 200 designates a resistor of a very small resistance value for detection of the critical current. Numeral 300 designates an input processing stage for detecting the voltage dropped across the resistor 200, amplifying the detected voltage by a desired amplification degree and outputting a desired characteristic of amplified voltage. Numeral 400 designates a control stage for controlling the operating condition of the voltage source 100. In response to the instructions from a computer 500, the control stage 400 gives an instruction to reduce or cut off the voltage applied to the air-fuel ratio sensor 1 when the air-fuel ratio sensor 1 is inactive or when the lean-side feedback control is not effected under a heavy load such as at the time of engine acceleration. Numeral 600 designates an A/D converter for analog-to-digital conversion of the output signal of the air-fuel ratio sensor 1, the output signal P of an intake manifold pressure sensor not shown, the output signal Tw representing the temperature of the engine cooling water and the output signal $\theta$ representing the opening degree of the throttle valve, which are processed sequentially in compliance with the instructions from the computer 500.

The computer 500, which may be a microcomputer operating with a software program and adapted to compute the quantity of fuel to be supplied to the engine from such data as the intake manifold pressure P and the engine rotational speed N and to drive injectors 800 through a drive stage 700 in order to supply the fuel of a desired quantity to the engine. Further, in the lean-side feedback control mode, the computer 500 detects the error between the air-fuel ratio determined in accordance with the critical current detected by the air-fuel ratio sensor and a predetermined target air-fuel ratio optimal to a current engine operating condition, and compensates for the amount of fuel supply previously computed, thus regulating the current air-fuel ratio to the target air-fuel ratio. Such target air-fuel ratios are set in advance as the respective optimal levels in correspondence with the engine conditions (such as those determined by P or N) and stored in part of the ROM (read-only memory) in the computer.

As the most desirable conditions for the lean-side feedback control, the air-fuel ratio sensor 1 should be in active state at 650° C. or higher, the temperature of the engine cooling water be 70° C. or higher in a warmed-up state, and the engine be in steadily or almost steadily operating condition and not under heavy load. All these conditions are not of course required to be satisfied.

Figure 4:
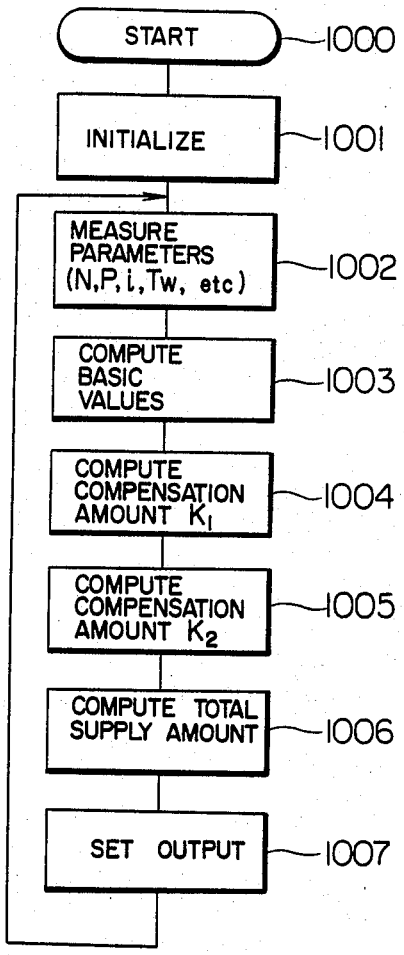
FIGS. 4 and 5 are flowcharts for explaining the operation of the present invention.

The operation of the computer 500 will be now briefly explained. In FIG. 4, upon starting the engine with the key switch turned on, the computing operations from first step 1000 to step 1007 are executed sequentially. Step 1001 is an initialization process, followed by step 1002 for reading digital values such as the engine rotational speed N, intake manifold pressure P, engine cooling water temperature Tw and the critical current i. Step 1003 reads out the basic amount of fuel supply from a basic amount map in accordance with the main parameters (P, N, etc.).

Step 1004 computes a compensation amount $K_1$ including a water temperature increment, an intake air temperature increment and increment for engine start in response to the signals indicative of the cooling water temperature, intake air temperature and starter switch actuation respectively, and stores the result of computation in a RAM in the computer 500. This compensation amount $K_1$ may include other compensation items specific to each engine such as a fuel increase for acceleration.

Step 1005 detects an actual air-fuel ratio in response to the signal of the air-fuel ratio sensor 1, and computes the compensation amount $K_2$ of the amount of supplied fuel in order for the air-fuel ratio to coincide with the target air-fuel ratio for the current operating conditions. Steps 1006 and 1007 compute the optimum amount of fuel supply under the current conditions on the basis of the basic amounts $K_1$ and $K_2$ determined at steps 1003, 1004 and 1005, and sets the resulting value in the output section. At a predetermined crank angle position, the amount of fuel obtained by the above computation data is supplied to the engine through the injector 800.

Figure 5:
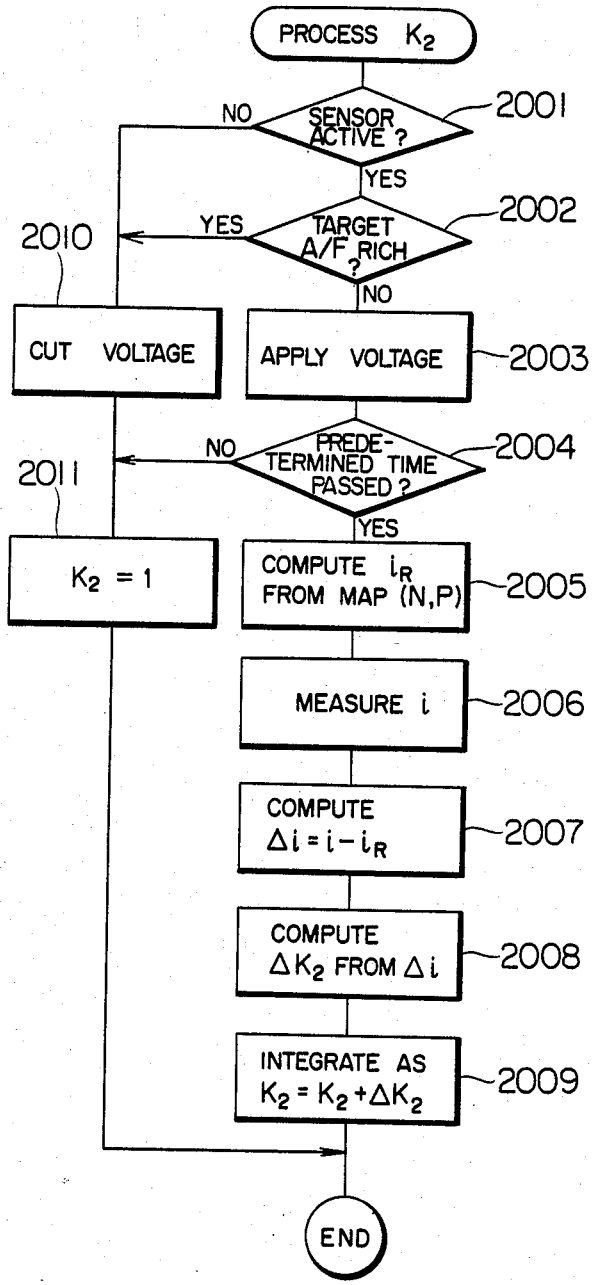

FIG. 5 is a detailed flowchart of step 1005. Step 2001 decides whether the air-fuel ratio sensor 1 is in active state or not, or the feed-back control of the air-fuel ratio is possible or not. Specifically, the temperature of the air-fuel ratio sensor 1 is detected to decide whether it is higher than a predetermined level, or a predetermined bias is applied to the air-fuel ratio sensor 1 to decide the activity of the sensor from the magnitude of the internal resistance of the sensor, or the active state is indirectly inferred from the temperature of cooling water, the time that has lapsed from engine start, or the accumulated number of combustions.

Step 2002 detects whether or not the target air-fuel ratio to be controlled is higher than about 15 thereby to decide whether or not a lean-side charge feedback control mode is involved. In other words, when the air fuel ratio is required to be controlled to a value smaller than 15 or to a rich mixture gas by increasing fuel amount under acceleration or heavy load, the process proceeds to step 2010 for cutting off the voltage applied to the air-fuel ratio sensor 1, either by reducing the applied voltage directly to a zero volt from a predetermined level or to a holding voltage lower than the predetermined voltage, or by slowly reducing the applied voltage to zero volt or the holding voltage. Step 2011 sets the compensation factor $K_2$ (=1) to eliminate the integration process.

In the case where the sensor is in active state and the lean-side feed-back control is possible, steps 2003 to 2009 are executed. First, step 2003 applies a predetermined voltage to the air-fuel sensor 1, and after the lapse of a predetermined time at step 2004, the process proceeds to step 2005. The voltage is applied in step 2003 in such a manner that a predetermined voltage is directly applied to the air-fuel ratio sensor 1 or the voltage applied to the sensor is increased slowly from zero or a holding voltage to a predetermined voltage level. Step 2005 reads out the critical current $I_R$ corresponding to the optimum target air-fuel ratio for the current operating condition from a predetermined map in accordance with the main parameters (N and P in this case). A predetermined time is allowed to elapse to confirm that the air-fuel ratio sensor 1 has reached a stable detection state. On the other hand, the current critical current i is measured from the air-fuel ratio sensor 1 (step 2006), an error $\Delta i$ $(=i-i_R)$ between them is determined (step 2007), and the amount of computation $\Delta K_2$ for integration process is determined in accordance with the error $\Delta i$ (step 2008). This integration amount $\Delta K_2$ may be changed with the magnitude of the error $\Delta i$ or may be kept constant, taking into consideration the control accuracy or the follow-up ability of feedback control or the matching with the engine. If the integration amount $\Delta K_2$ increased with the increase of error $\Delta i$, the compensation amount $K_2$ determined from the integration process $K_2=K_2+\Delta K_2$ changes greatly, so that the fuel supply amount can be controlled optimally and the follow-up ability is further improved (step 2009).

As explained above, by using the control method shown in FIGS. 4 and 5, the feedback control is effected to attain the target air-fuel ratio.

Figure 6:
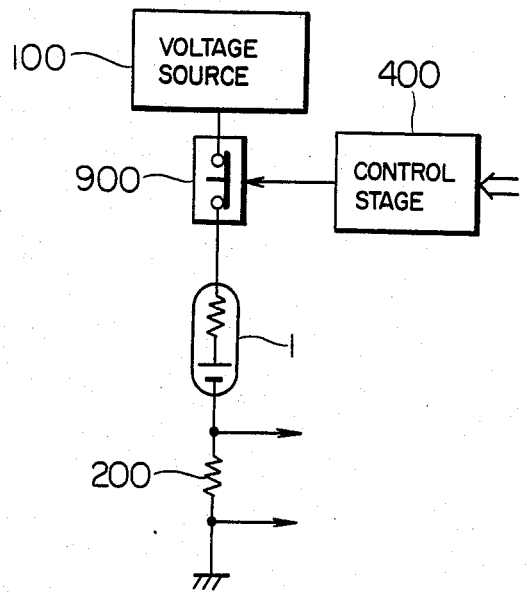
FIGS. 6 and 7 are block diagrams showing other embodiments of the present invention.
Figure 7:
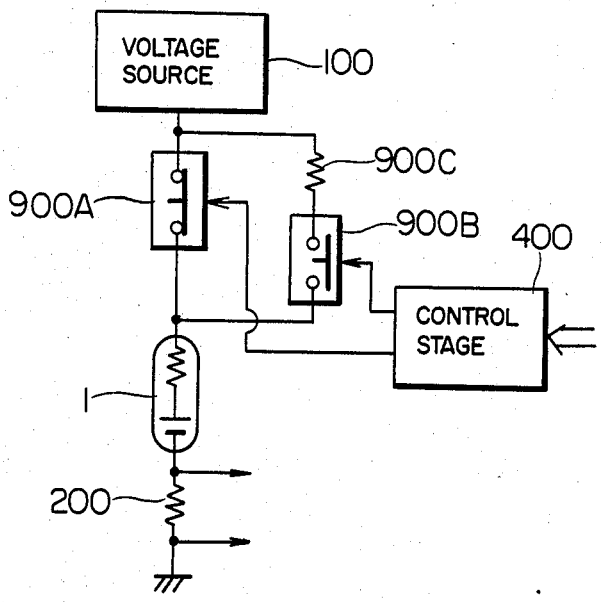

Instead of controlling the operation of the voltage source 100 to reduce or cut off the generated voltage by the computer 500 and the control stage 400 as in the aforementioned embodiment, an analog switch may be inserted between the voltage source 100 and the air-fuel ratio sensor 1 as shown in FIG. 6 and may be opened when the lean-side feedback is not effected. As another alternative, an analog switch 900A in parallel with a series circuit including a resistor 900C and an analog switch 900B may be inserted between the voltage source 100 and the air-fuel ratio sensor 1 as shown in FIG. 7 so that when the lean-side feedback control is effected, the switch 900A is closed and the switch 900B is opened, while when the lean-side feedback control is not involved, the switch 900A is opened and the switch 900B is closed to thereby limit the current in the air-fuel ratio sensor 1, thus reducing the voltage applied to the air-fuel ratio sensor 1.

In the above-mentioned embodiment, the voltage applied to the air-fuel ratio sensor 1 is reduced or cut off except at the time of feedback control with lean air-fuel mixture. Under this condition, especially at the time of engine start, the power supply to the heater in the air-fuel ratio sensor 1 may be stopped as specifically explained below.

Figure 8:
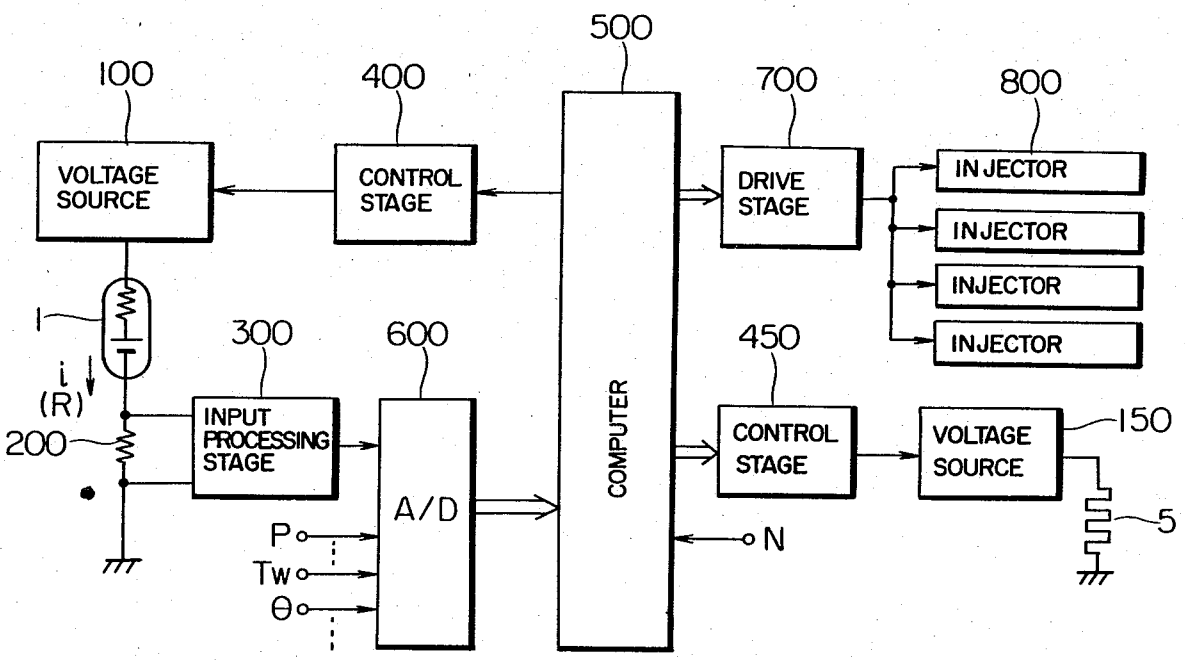
FIGS. 8 and 9 are block diagrams showing specific examples of a heater control according to the present invention.

A specific example of such a method is shown in FIG. 8, in which a control stage 450 and a source of the voltage to be applied to the heater 5 are added to the control system shown in FIG. 3. The computer 500 instructs the control stage 450 to reduce the output of the voltage source 150 to zero and to stop power supply to the heater 5 when an engine start condition is detected. As a result, when a large amount of current (power) is required such as at the time of engine start, the reduction in the source voltage is prevented to improve the starting characteristics of the engine by cutting off the load such as heater 5.

The starting characteristics of the engine can be determined by detecting the drop of the terminal voltage of the car battery or the output voltage of the power supply or the presence or absence of the operating signal for the starter switch.

After the engine is started, the voltage applied to the heater 5 is controlled in accordance with the engine load or by detecting the sensor temperature. In this way, the sensor temperature is maintained substantially at a predetermined level.

Figure 9:
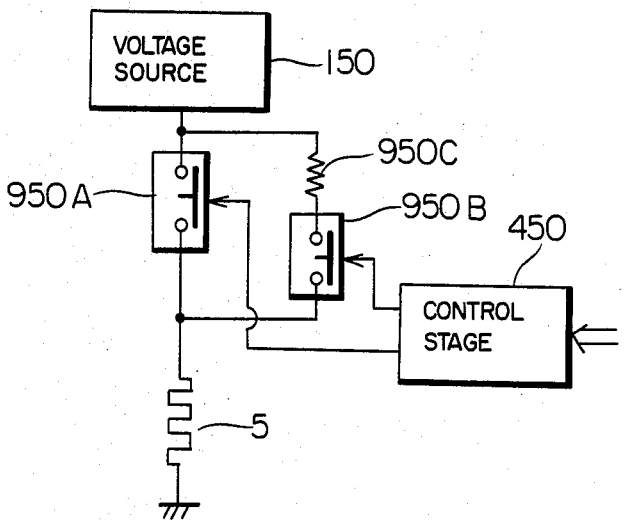

FIG. 9 shows a specific example of heater control. Analog switches 950A, 950B and a current-limiting resistor 950C are inserted and controlled by the control stage 450. First, when the engine is running under small load, the exhaust gas temperature is low, so that the analog switch 950A is turned on and the analog switch 950B turned off to increase the heat generation of the heater 5 with a high voltage applied thereto. When the engine is running under heavy load with the exhaust gas at high temperature, on the other hand, the analog switch 950A is turned off and the analog switch 950B turned on to thereby apply a voltage reduced by a voltage dividing resistor 950C to the heater 5, thereby maintaining the sensor temperature substantially at a fixed level.

When the engine is started, both the analog switches 950A and 950B are turned off, to reduce the power consumption for starting, thus improving the starting characteristics.

We claim:

1. A system for controlling the air-fuel ratio of mixture gas supplied to an internal combustion engine, comprising:

an air-fuel ratio sensor, selectively applied with a predetermined bias voltage, for producing a characteristic saturation output current depending on concentration of oxygen contained in exhaust gas of said engine;

means, responsive to said output current, for controlling said air-fuel ratio of said mixture gas supplied to said engine; and voltage regulation means for suspending function of said controlling means and reducing said bias voltage applied to said sensor when said controlling means determines that said engine requires a rich air-fuel ratio of said mixture gas.

2. A system according to claim 1, wherein said voltage regulation means reduces said bias voltage applied to said sensor to a value lower than a minimum value necessary for operation of said controlling means.

3. A system according to claim 1, wherein said voltage regulation means reduces to zero said bias voltage applied to said sensor.

4. A system according to claim 1, wherein said voltage regulation means gradually changes said bias voltage applied to said sensor to a level in accordance with current functioning of said controlling means.

5. A system for controlling the air-fuel ratio of mixture gas supplied to an internal combustion engine, comprising:

an air-fuel ratio sensor in an exhaust pipe of said engine and selectively applied with a predetermined bias voltage for producing a characteristic saturation output current in accordance with composition of said exhaust gas;

a sensor for detecting load on said engine;

means for controlling, responsive to said engine-load sensor, said air-fuel ratio to provide an amount of fuel required by said engine and, for correcting, responsive to said air-fuel sensor, said fuel amount to attain a target air-fuel ratio depending on engine operating conditions; and voltage regulation means for reducing said bias voltage applied to said air-fuel ratio sensor when said air-fuel ratio sensor is inactive to thereby reduce physical deterioration of said sensor.

6. A system according to claim 5, wherein said voltage regulation means reduces to zero said bias voltage applied to said air-fuel ratio sensor.

7. A system for controlling the air-fuel ratio of mixture gas supplied to an internal combustion engine, comprising:

an air-fuel ratio sensor having a cup-shaped solid electrolytic element with its interior exposed to a reference gas and its exterior exposed to exhaust gas of said engine, said air-fuel ratio sensor being selectively applied with a predetermined bias voltage and producing a characteristic saturation output current in accordance with the concentration of oxygen in said exhaust gas;

voltage control means for controlling said bias voltage applied to said sensor;

first means for calculating a basic amount of fuel required by said engine in accordance with a plurality of operation paratmeters of said engine;

second means for calculating a feedback compensation amount in accordance with said output current of said air-fuel ratio sensor;

third means for suspending said feedback compensation of said second means and for reducing said bias voltage applied to said air-fuel ratio sensor, by controlling said voltage control means, when said engine is in a condition requiring a rich mixture gas; and fourth means for determining an actual amount of fuel supply in accordance with said basic amount and said feedback compensation amount and for controlling supply of fuel to said engine in accordance with said determined actual amount.

8. A system according to claim 7, wherein said third means reduces said bias voltage applied to said air-fuel sensor whenever a rich mixture gas condition occurs such that oxygen concentration in said exhaust gas is almost zero and oxygen ions are not generated by said sensor, which would thereby otherwise result in deterioration of said air-fuel ratio sensor.

9. A system according to claim 7, wherein said third means also suspends application of current to a heater of said air-fuel ratio sensor while suspending said feedback compensation.

* * * * *